United States Patent [19]

Solia

[11] Patent Number: 4,924,797

[45] Date of Patent: May 15, 1990

[54] MOTOR-BOAT HULL

[75] Inventor: Franco Solia, Milan, Italy

[73] Assignee: Akzo S.r.l., Milan, Italy

[21] Appl. No.: 213,949

[22] Filed: Jul. 1, 1988

[30] Foreign Application Priority Data

Jul. 1, 1987 [IT] Italy ..... 53488/87[U]

[51] Int. Cl.[5] ..... B63B 1/20

[52] U.S. Cl. ..... 114/288; 114/290; 114/291; 114/283; 440/67; 440/69

[58] Field of Search ..... 114/288, 290, 291, 140, 114/275, 274, 283; 440/66–70, 49

[56] References Cited

U.S. PATENT DOCUMENTS

| | | | |
|---|---|---|---|
| 3,469,549 | 9/1969 | Rae | 114/291 |
| 3,547,064 | 12/1970 | Glass | 114/291 |
| 3,608,512 | 9/1971 | Thompson | 440/67 |
| 3,661,109 | 5/1972 | Weiland | 114/291 |
| 3,789,792 | 2/1974 | Smith | 440/67 |
| 4,193,370 | 3/1980 | Schoell | 114/291 |
| 4,231,314 | 11/1980 | Peters | 114/291 |
| 4,726,310 | 2/1988 | Ard | 114/291 |

*Primary Examiner*—Joseph F. Peters, Jr.
*Assistant Examiner*—Clifford T. Bartz
*Attorney, Agent, or Firm*—Sughrue, Mion, Zinn, Macpeak & Seas

[57] ABSTRACT

A motor-boat hull (10) includes a planing bottom (C) having a V-shaped forward portion, two float-like side portions (14) connected forwardly to the V-shaped portion (12), and a flat recessed aft portion (16) delimited by the side portions (14) and forwardly by a transverse step (18) connecting it with the V-shaped forward portion (12) of the bottom (C).

3 Claims, 3 Drawing Sheets

MOTOR-BOAT HULL

BACKGROUND OF THE INVENTION

The present invention relates to a motor-boat hull of the type provided with a planing bottom.

Conventional planing bottoms, as is known, have the disadvantage that they are subject to abrupt pitching movements, commonly known as porpoising, due to the displacement of the pressure centre on the bottom alternately fore and aft of the centre of gravity. In order to prevent the centre of thrust from being displaced too far aft as the speed of the boat increases, stepped or three-point planing bottoms have been produced which enable high speeds to be reached and the porpoising to be eliminated, but have the disadvantage that, whilst planing, they are disturbed even by small waves and can therefore only sail if the surface of the water is perfectly calm.

SUMMARY OF THE INVENTION

The object of the present invention is to provide a hull which does not have the above problems and which is fast, light and cheap to produce.

According to the invention, this object is achieved by virtue of the fact that the bottom includes a V-shaped forward portion which extends from the bow to a central zone of the bottom, two substantially flat-bottomed side portions which converge and decrease in width from the stern to the bow and are connected to the V-shaped forward portion of the bottom, and a substantially flat recessed aft portion delimited laterally by the side portions and forwardly by a transvere step connecting it with the V-shaped forward portion of the bottom, and by virtue of the fact that the hull has a propeller which is situated in correspondence with the central zone of the bottom, aft of the V-shaped forward portion of the bottom.

By virtue of these characteristics, the hull is constantly parallel to the surface of the water when planing and the two side portions behave like two aft floats which become reaction points without a structural function, enabling the structure of the hull to be much lighter and therefore cheaper for a given length.

Moreover, the forward portion of the bottom enables comfortable sailing even with large waves, despite the high speed which can typically be reached by three-point bottoms by virtue of an easy passage over the waves.

BRIEF DESCRIPTION OF THE DRAWINGS

Further characteristics and advantages of the hull according to the invention will become clear from the detailed description which follows with reference to the appended drawings, provided by way of non-limiting example, in which.

DETAILED DESCRIPTION OF THE INVENTION

Figure 1:
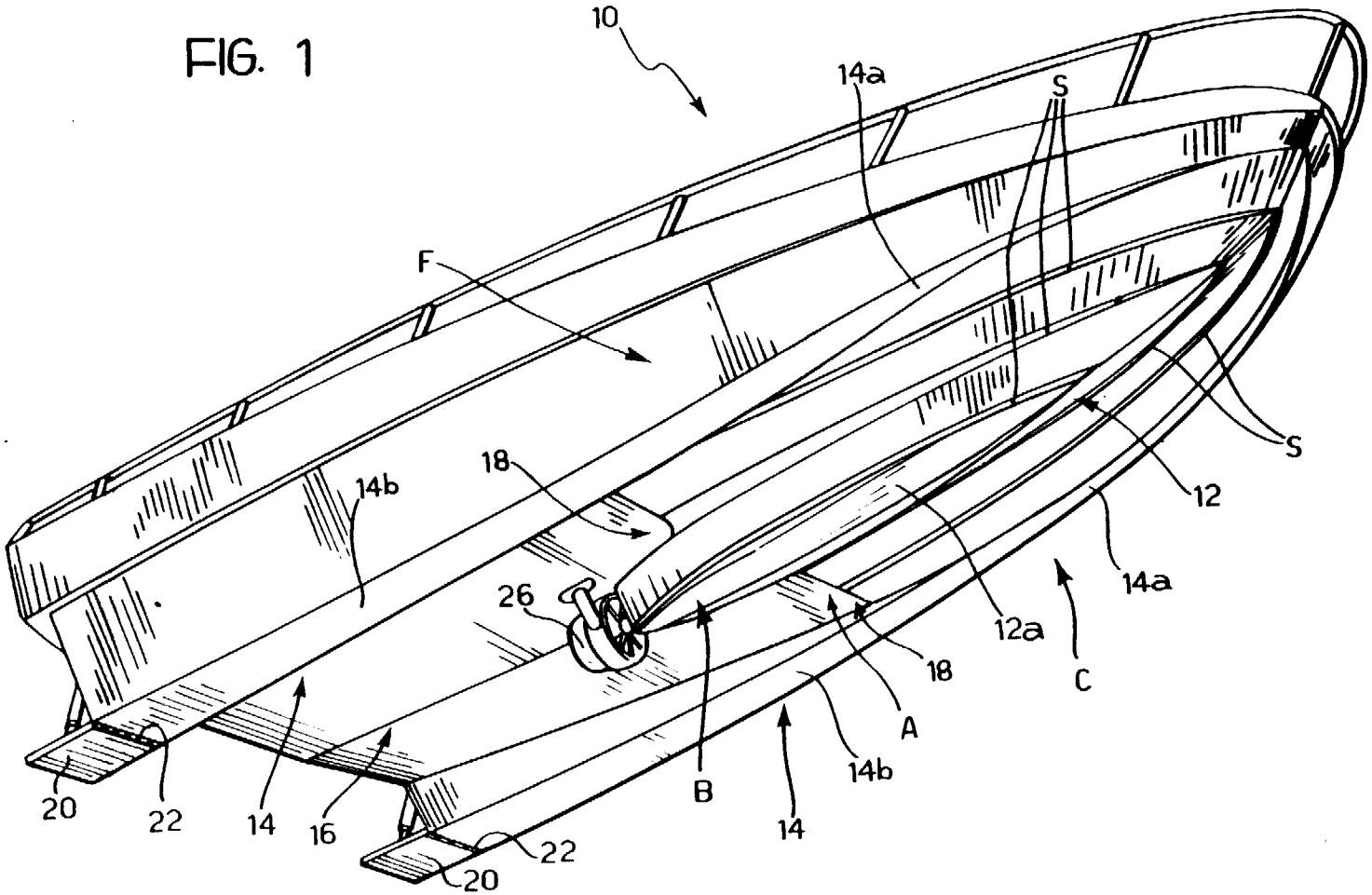
FIG. 1 is a perspective view of a hull according to the invention from below.

With reference to the drawings, a motor-boat hull is generally indicated 10 and has a planing bottom C divided into a forward bottom portion 12, two side floats 14 extending along substantially the whole length of the hull 10, and a flat recessed portion 16 between the longitudinal floats 14 and the forward bottom portion 12.

Figure 4:
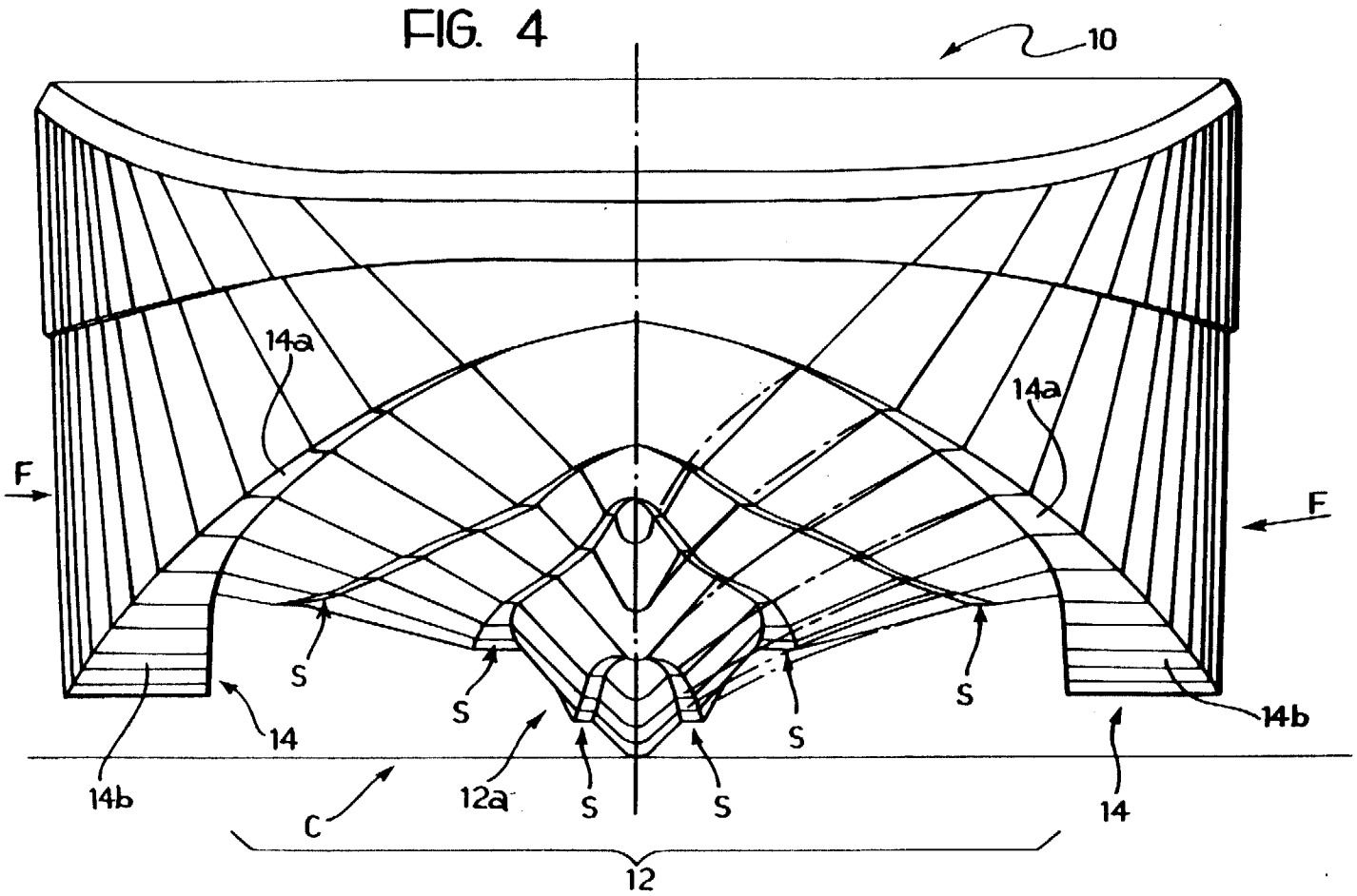
FIG. 4 is a view taken on the arrow IV of FIG. 2, in which the vertical sections of the bottom are shown.

The forward bottom portion 12, which is of the "Hunt" type with longitudinal steps S, extends from the bow to a central zone, indicated A, of the bottom C. The forward bottom portion 12 has a deeper central V-shaped zone **12*a* which extends aft in correspondence with the recessed portion 16 of the bottom. A transverse step 18 is defined between the latter and the forward bottom portion 12 and is divided into two parts by the deep central V-shaped zone 12*a*. Alternatively, the forward bottom portion 12 may be without steps in its central part, as shown in broken outline on the right-hand side of FIG. 4**.

The aft portions **14*b* of the longitudinal floats 14 are defined by the extensions of two steps 14*a* of the forward bottom portion aft beyond the central zone A of the bottom, as well as by the sides F of the hull. Two flaps 20 are arranged as aft extensions of the aft portions 14*b* of the longitudinal floats 14 and are hinged to the hull 10 at 22 for varying the attitude of the hull 10** when it is under way.

The deep central V-shaped zone **12*a* of the forward bottom portion 12 which extends beyond the transverse step 18, indicated B in the drawings, is tapered so as to enable the fluid threads to be directed in correspondence with a ducted propeller 26. The recessed portion 16 of the bottom, in correspondence with which the propeller 26** is situated, may be flat or may have a slight dihedral in cross-section (the solution illustrated in the drawings).

Figure 2:
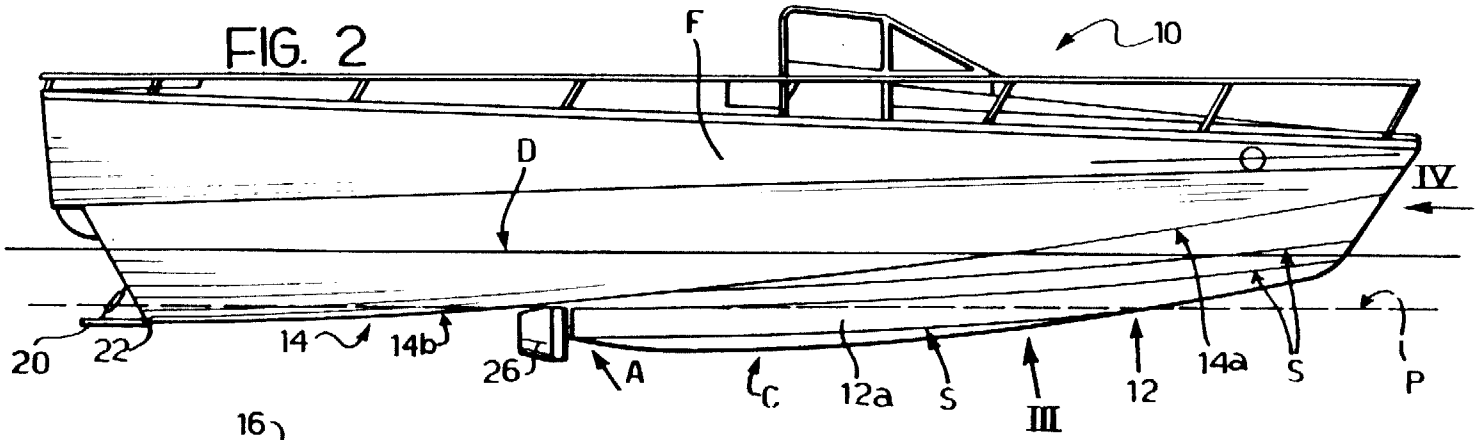
FIG. 2 is a side view of the hull of FIG. 1.
Figure 3:
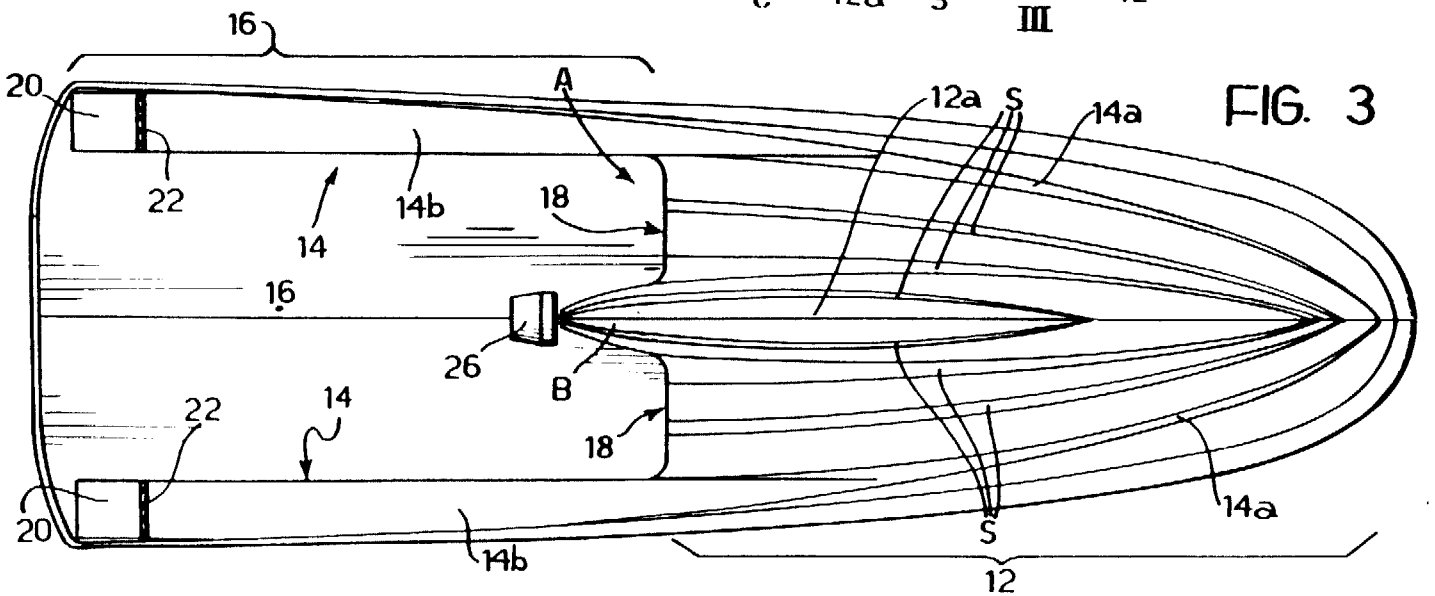
FIG. 3 is a view taken on the arrow III of FIG. 2.

The waterline in the displacing configuration is indicated D in FIG. 2, whilst the waterline in the planing configuration (the broken line in FIG. 2) is indicated P. It is obvious that the hull 10 will remain parallel to the surface of the water when it is under way with considerably reduced pitching. When planing, the hull 10 will be lifted onto both the forward bottom portion 12 and the rear portions **14*b* of the floats 14, raising the whole of the recessed bottom portion 16** with the advantage of a reduced wetted area and therefore less resistance to forward movement.

According to another embodiment, the ducted propeller may to advantage be replaced by a surface propeller.

I claim:

1. A motor-boat hull of the type having a planing bottom comprising:

a V-shaped forward portion extending from the bow to a central zone of the bottom;

two substantially flat-bottomed side portions which converge and decrease in width from the stern to the bow and are connected to the V-shaped forward portion of the bottom; and a substantially flat recessed aft portion delimited laterally by the side portions and forwardly by a transverse step connecting it with the V-shaped forward portion of the bottom;

wherein the bottom has a deep central V-shaped zone having a tapered end portion which extends aft of the step in overlying relation with the recessed aft portion; and propeller means located in said central zone aft of the tapered end portion of the central V-shaped zone.

2. A motor-boat hull according to claim 1 further comprising a pair of flaps hinged to the aft portion of said flat-bottomed side portions respectively to define aft extensions of said side portions.

3. A motor-boat hull according to claim 1, wherein said propeller means is a ducted propeller.

* * * * *